US009931843B2

(12) United States Patent
Brick et al.

(10) Patent No.: US 9,931,843 B2
(45) Date of Patent: Apr. 3, 2018

(54) RAISED FLUID PASS-THROUGH STRUCTURE IN PRINT HEADS

(71) Applicant: XEROX CORPORATION, Norwalk, CT (US)

(72) Inventors: Jonathan R. Brick, Tualatin, OR (US); Chad D. Freitag, Portland, OR (US); Garry A. Jones, King City, OR (US); Jon G. Judge, Tigard, OR (US); David R. Koehler, Sherwood, OR (US); Chad J. Slenes, Sherwood, OR (US); Peter J. Nystrom, Webster, NY (US); Gary D. Redding, Victor, NY (US); Mark A. Cellura, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 15/724,912

(22) Filed: Oct. 4, 2017

(65) Prior Publication Data

US 2018/0022094 A1 Jan. 25, 2018

Related U.S. Application Data

(62) Division of application No. 14/629,877, filed on Feb. 24, 2015, now Pat. No. 9,802,408.

(51) Int. Cl.
*B41J 2/14* (2006.01)
*B41J 2/16* (2006.01)

(52) U.S. Cl.
CPC ..... *B41J 2/1433* (2013.01); *B41J 2/14072* (2013.01); *B41J 2/1601* (2013.01); *B41J 2/1626* (2013.01); *B41J 2/1632* (2013.01); *B41J 2/1634* (2013.01); *B41J 2002/14475* (2013.01); *B41J 2202/16* (2013.01)

(58) Field of Classification Search
CPC ..... B41J 2/1433; B41J 2/1634; B41J 2/1626; B41J 2/1601; B41J 2/1632; B41J 2/14072; B41J 2002/14475; B41J 2202/16
See application file for complete search history.

(56) References Cited

U.S. PATENT DOCUMENTS

2013/0307903 A1* 11/2013 Dolan ..... B41J 2/161 347/44

* cited by examiner

*Primary Examiner* — Bradley Thies
(74) *Attorney, Agent, or Firm* — Marger Johnson

(57) ABSTRACT

A print head includes a substrate having a hole, a circuit on the substrate, the circuit having traces and a hole corresponding to the hole in the substrate, the hole forming a fluid path, and a raised structure on the substrate around the fluid path, the raised structure positioned to seal the circuit from the fluid path.

15 Claims, 3 Drawing Sheets

RAISED FLUID PASS-THROUGH STRUCTURE IN PRINT HEADS

CROSS REFERENCE TO RELATED APPLICATION

This application is a divisional of and claims priority to U.S. patent application Ser. No. 14/629,877 filed Feb. 24, 2015, which is incorporated herein in its entirety by reference.

TECHNICAL FIELD

This disclosure relates to print heads, more particularly to print heads having flex circuits and ink pass through paths.

BACKGROUND

A typical print head design passes ink from an ink reservoir at the back of the print head to the jet stack at the front of the print head through various layers of metal, polymer and and/or adhesive layers. The ink passes through a fluidic channel that penetrates these layers one of which is a flex circuit. The term flex circuit as used here means a polymer layer, such as polyimide, having electrically conductive traces that route near and around the clearance holes that pass through the print head. These traces have a topography associated with them that makes sealing around the ink ports difficult, even when using compliant adhesives.

Because of the topography, when the layers are pressed together leaks sometimes occur within layers. If the ink leaks into any layer upon which electrical signals run, they will short out and the print head will not operate. In addition, leaks alter the pressures of the ink flows in the print head which can cause other problems.

SUMMARY

A print head includes a substrate having a hole, a circuit on the substrate, the circuit having traces and a hole corresponding to the hole in the substrate, the hole forming a fluid path, and a raised structure on the substrate around the fluid path, the raised structure positioned to seal the circuit from the fluid path.

Another embodiment consists of a multi-layer structures a substrate having a hole, at least one layer on the substrate having a hole corresponding to the hole in the substrate, and a raised structure on the substrate surrounding the hole such that the layer is sealed off from the hole.

Another embodiment consists of a method of manufacturing a print head, including providing a substrate, forming a hole in the substrate, the hole configured to accommodate a fluid path, forming a structure on the substrate surrounding the hole, and attaching a flex circuit to the substrate, the flex circuit having a hole to accommodate the structure.

DETAILED DESCRIPTION OF THE EMBODIMENTS

Figure 1:
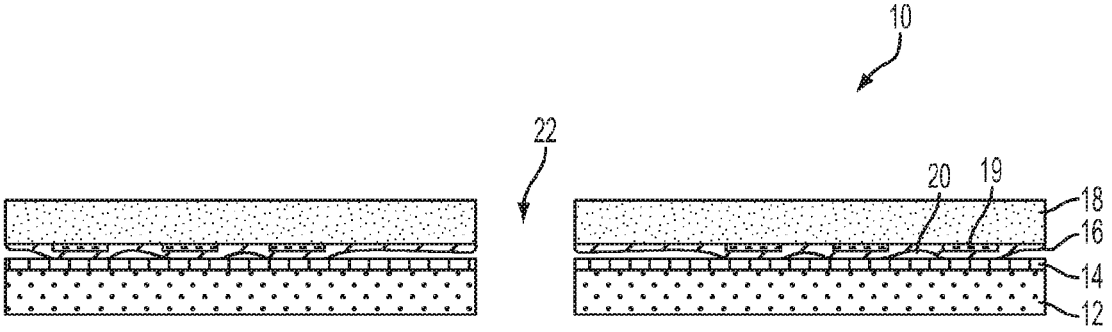
FIGS. 1 and 2 show fluid paths in current print head architecture designs.
Figure 2:
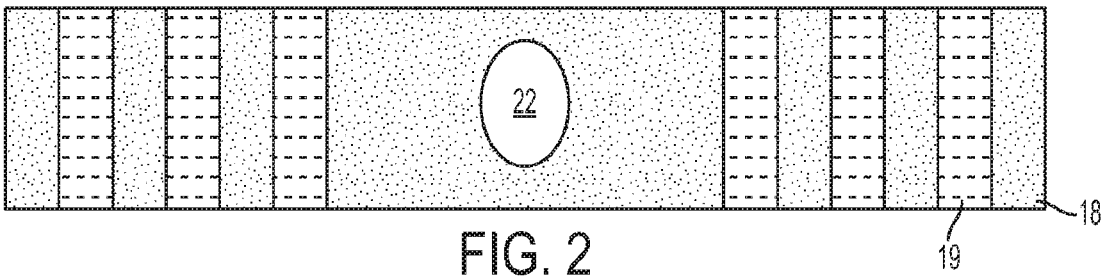

FIGS. 1 and 2 show fluid paths in current print head architectures. The print head may consist of other components, but most will typically include at least the components discussed here. In FIG. 1, the print head 10 has a substrate 12 has a layer of adhesive 14 to which the flex circuit attaches. The flex circuit 18 has metal contact traces and contact pads such as 19 and typically a solder mask 16. These raised features prevent the flex circuit from having a planar surface. As a result, gaps such as 20 exist in the bond between the flex circuit and the adhesive. When ink flows through the channel 22, it leaks into these gaps. FIG. 2 shows a view of the bottom of the flex circuit having its portion of the ink channel 22 and the traces 19.

The ink leaking into the gaps can cause a host of problems including shorts in the transducer signals causing jets to fail, altering the pressures in the ink path, print head failure, etc. Current print head architectures require sealing each individual interface between different layers. In some print heads, this may mean sealing 8 different interfaces between: substrate and adhesive; adhesive and flex circuit; flex circuit and adhesive; adhesive and first layer of polyimide; first layer of polyimide and adhesive; adhesive and second polyimide; second polyimide and adhesive; and adhesive and top substrate. This raises the costs of manufacture of the printhead, and more potential points of failure in its performance.

Figure 3:
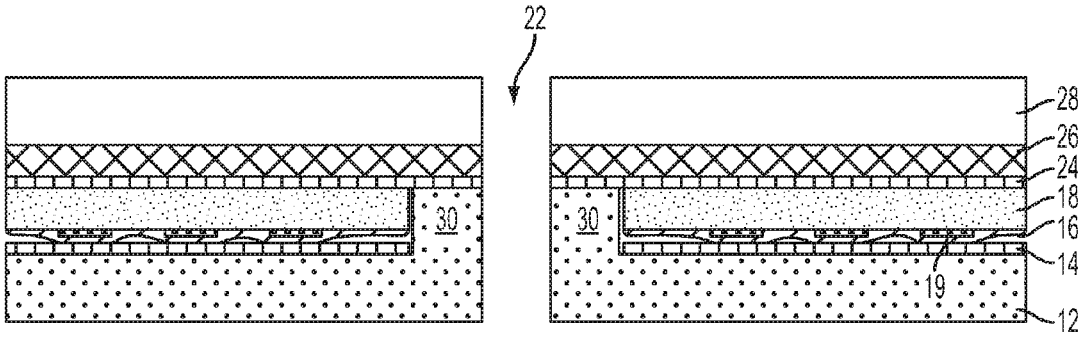
FIGS. 3 and 4 show fluid paths having raised structures around the fluid paths.

In the embodiments here such as that shown in FIG. 3, a structure 30 is on the substrate 12. The raised structure separates the various layers 14, 16, 18, 24, 26 and 28 from the ink channel 22. Layer 28 may be further layers of the print head, including the jet stack, or other intermediate layers as will be discussed in more detail further. One should note that the circuit does not have to be a flex circuit and there does not have to be any adhesive used, the circuit could just reside on the substrate.

Figure 4:
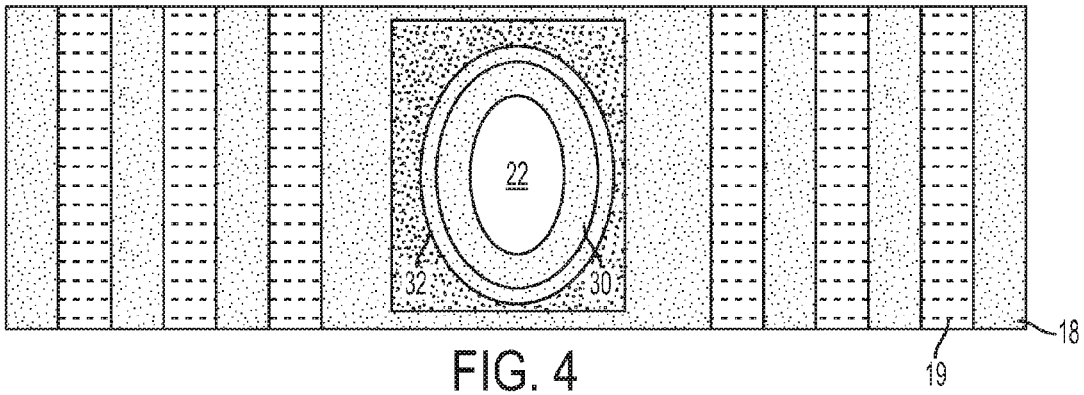

FIG. 4 shows a bottom layer of the flex circuit substrate. The hole that makes up part of the ink channel 22 is surrounded by the structured 30 and a clearance hole 32. Using this structure, the structure takes the place of the seals required between the various layers and the ink channel The structure may be referred to here as a chimney or a raised structured, even though part of the structure may actually come 'down' from another layer within the stack of layers in the structure. The top of the structure will move the sealing interface up to another layer in which no topography exists that causes gaps.

Figure 5:
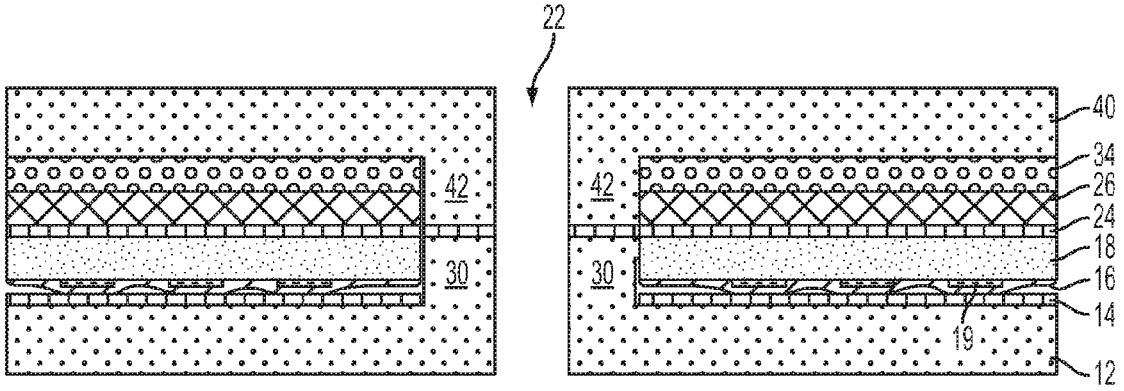
FIG. 5 shows an alternative embodiment of a fluid path having raised structures around the fluid path.

As an alternative embodiment, the protruding structure may be added to a different layer, further improving reliability. FIG. 5 shows an example of this embodiment. The substrate 12 has raised structures 30. The layer of adhesive 14 attaches the flex circuit 18 with the solder mask 16 and the traces 19. An adhesive layer 24 attaches a first intermediate layer, in this case polyimide layer 26. The intermediate layers may consist of several different layers, the ones shown in FIG. 5 are merely examples of other layers. A further layer 34 may consist of a second polyimide layer. Another intermediate layer 40 may include another protruding structure 42 that aligns with and mates with the raised structure 30 from the substrate through the adhesive layer 24. This mating further provides separation between the ink in the channel and the layers of the print head.

One should note that the structure here relates to a print head but may be applicable to any multi-layer structure in which a fluid channel passes through the layers of the structure and those layers need to be sealed off from the fluid in the channel The multi-layer structure will have a substrate, a fluid channel, and at least one other layer. The substrate and the other layer will have holes to accommodate the fluid channel as set out above, but the fluid channel could be any type of fluid other than ink.

The resulting structure now has only one interface that has to be sealed as well as attached. This interface is between the bottom substrate and the adhesive, and between the adhesive and the top substrate, if that is the embodiment used. The layers are still attached, but they do not have to be sealed.

Manufacture of the structure may involve removing a portion of the substrate in a removal type process, such as etching or laser ablation. Alternatively, additive techniques can build or deposit the structure on the substrate, including electroforming, direct metal laser sintering, casting the substrate with the structures, or molding the substrate with the structure. Typically, the structure will be formed on the substrate and then the other layers will be attached. The hole in the other layer will be aligned with the structure formed on the substrate, or provide clearance so as to not interfere. Some features on the structure may provide alignment and these just fit with the associated clearances and tolerances.

In the case of a print head, the other layer will be the flex or other type of circuit. The holes in the flex circuit and the substrate may be similarly formed in one of many ways, including cutting, etching, punching, etc. The further layers of the print head, including the transducer layer and the jet stack will also be attached. In the embodiment of the protruding structure being used, the protruding structure may be formed in one of any of the other intermediate layers and then at the appropriate step in the process the intermediate layer will be mated with the raised structure on the substrate.

In this manner, the ink or fluid channel is completely separated from the layers that attach to the substrate. This eliminates any issues with ink leakage and increases the reliability of the print head. In addition, it may reduce the cost of manufacturing the print head and certainly reduces the complexity of the process with regard to sealing.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method of manufacturing a print head, comprising:
providing a substrate;
forming a hole in the substrate, the hole configured to accommodate a fluid path;
forming a raised structure on the substrate surrounding the hole, the raised structure forming a portion of a fluid path and having only one interface requiring seal against fluid leakage; and
attaching a flex circuit to the substrate, the flex circuit having a hole to accommodate the raised structure and the raised structure positioned to separate the circuit from the fluid path.

2. The method of claim 1, further comprising attaching a transducer layer to the flex circuit.

3. The method of claim 1, further comprising attaching a jet stack to the transducer layer.

4. The method of claim 1, wherein forming the structure on the substrate comprises forming a raised structure on the substrate.

5. The method of claim 1, wherein forming a raised structure on the substrate comprises one of etching the substrate, electroforming, direct metal laser sintering, casting, and molding.

6. The method of claim 1, wherein forming the structure comprises forming the structure from the substrate and at least one intermediate layer.

7. A method of manufacturing a print head, comprising:
providing a substrate;
forming a hole in the substrate, the hole configured to accommodate a fluid path;
forming a raised structure from a portion of the substrate surrounding the hole, the raised structure forming a portion of a fluid path and having only one interface requiring seal against fluid leakage; and
attaching a flex circuit to the substrate, the flex circuit having a hole to accommodate the raised structure and the raised structure positioned to separate the circuit from the fluid path.

8. The method of claim 7, further comprising attaching a transducer layer to the flex circuit.

9. The method of claim 7, further comprising attaching a jet stack to the transducer layer.

10. The method of claim 7, wherein forming a raised structure from a portion of the substrate comprises one of etching the substrate, electroforming, direct metal laser sintering, casting, and molding.

11. A method of manufacturing a print head, comprising:
providing a substrate;
forming a hole in the substrate, the hole configured to accommodate a fluid path;
forming a raised structure from a portion of the substrate surrounding the hole;
forming a protruding structure on an intermediate layer;
aligning and mating the protruding structure on the intermediate layer and the raised structure from a portion of the substrate, to form a raised structure, the raised structure forming a portion of a fluid path; and
attaching a flex circuit to the substrate, the flex circuit having a hole to accommodate the raised structure and the raised structure positioned to separate the circuit from the fluid path.

12. The method of claim 11, further comprising attaching a transducer layer to the flex circuit.

13. The method of claim 11, further comprising attaching a jet stack to the transducer layer.

14. The method of claim 11, wherein forming the raised structure from the portion of the substrate comprises one of etching the substrate, electroforming, direct metal laser sintering, casting, and molding.

15. The method of claim 11, wherein aligning and mating the protruding structure comprises attaching the protruding structure with an adhesive between the protruding structure and the raised structure from the portion of the substrate.

* * * * *